US010060588B2

(12) United States Patent
Madelaine et al.

(10) Patent No.: US 10,060,588 B2
(45) Date of Patent: Aug. 28, 2018

(54) MOTOR VEHICLE HEADLAMP LIGHTING MODULE WITH MUTUAL POSITIONING OF REFLECTOR AND LENS

(71) Applicant: Valeo Vision, Bobigny (FR)

(72) Inventors: Mehdi Madelaine, Maze (FR); Eric Chatel, Montreuil Juigne (FR)

(73) Assignee: VALEO VISION, Bobigny (FR)

( * ) Notice: Subject to any disclaimer, the term of this patent is extended or adjusted under 35 U.S.C. 154(b) by 106 days.

(21) Appl. No.: 14/751,867

(22) Filed: Jun. 26, 2015

(65) Prior Publication Data

US 2015/0377439 A1 Dec. 31, 2015

(30) Foreign Application Priority Data

Jun. 30, 2014 (FR) ..... 14 56227

(51) Int. Cl.

| | |
|---|---|
| ***F21V 7/00*** | (2006.01) |
| ***F21S 41/29*** | (2018.01) |
| ***F21S 41/19*** | (2018.01) |
| ***F21S 41/147*** | (2018.01) |
| ***F21S 41/39*** | (2018.01) |
| ***F21S 45/49*** | (2018.01) |
| ***F21S 45/47*** | (2018.01) |
| *F21S 41/32* | (2018.01) |

(52) U.S. Cl.

CPC ..... *F21S 41/29* (2018.01); *F21S 41/147* (2018.01); *F21S 41/192* (2018.01); *F21S 41/295* (2018.01); *F21S 41/39* (2018.01); *F21S 45/47* (2018.01); *F21S 45/49* (2018.01); *F21S 41/321* (2018.01)

(58) Field of Classification Search

CPC ..... F21S 48/10; F21S 48/11; F21S 48/1208; F21S 48/1258; F21S 48/1109; F21S 48/1159; F21S 48/1216; F21S 48/1305; F21S 48/321; F21S 48/328; F21S 48/332; F21S 48/335; F21S 48/32; F21S 48/323

USPC ..... 362/516, 538, 546, 507, 520

See application file for complete search history.

(56) References Cited

U.S. PATENT DOCUMENTS

| | | | | |
|---|---|---|---|---|
| 6,819,506 | B1 * | 11/2004 | Taylor | F21L 4/005 359/708 |
| 8,287,167 | B2 | 10/2012 | Inaba | |
| 8,534,888 | B2 | 9/2013 | Yasuda et al. | |
| 8,851,721 | B2 | 10/2014 | Woodward | |

(Continued)

FOREIGN PATENT DOCUMENTS

| | | |
|---|---|---|
| EP | 2428725 A2 | 3/2012 |
| EP | 2522898 A2 | 11/2012 |

(Continued)

*Primary Examiner* — Elmito Breval
*Assistant Examiner* — Omar Rojas Cadima
(74) *Attorney, Agent, or Firm* — Oblon, McClelland, Maier & Neustadt, L.L.P.

(57) ABSTRACT

A lighting module for a motor vehicle. The lighting module has least one light source; a heat sink; a reflective surface able to reflect the rays from the light source or sources; a lens that deflects the rays from the reflective surface so as to form a beam of light along an optical axis of the module; and a support of the lens and of the reflective surface, the support being mounted on the heat sink. The heat sink and/or the support comprises at least one boss that maintains a predetermined distance between the heat sink and the support.

16 Claims, 5 Drawing Sheets

(56) References Cited

U.S. PATENT DOCUMENTS

| | | | | |
|---|---|---|---|---|
| 8,939,627 | B2 | 1/2015 | Yatsuda | |
| 9,039,262 | B2 | 5/2015 | Yasuda et al. | |
| 2008/0165548 | A1* | 7/2008 | Misawa | B60Q 1/2607 362/487 |
| 2010/0073950 | A1* | 3/2010 | Kawamura | B60Q 1/2696 362/538 |
| 2010/0246204 | A1 | 9/2010 | Inaba | |
| 2012/0063156 | A1 | 3/2012 | Yasuda et al. | |
| 2012/0287658 | A1 | 11/2012 | Tanaka et al. | |
| 2013/0107564 | A1 | 5/2013 | Yatsuda | |
| 2013/0120988 | A1 | 5/2013 | Woodward | |
| 2013/0141927 | A1* | 6/2013 | Kenyon | B60Q 1/0035 362/485 |
| 2013/0235606 | A1 | 9/2013 | Yasuda et al. | |
| 2014/0140085 | A1 | 5/2014 | Matsumoto | |
| 2014/0192529 | A1* | 7/2014 | Wilcox | F21V 3/00 362/244 |
| 2014/0321145 | A1* | 10/2014 | Anzai | F21S 48/1317 362/516 |

FOREIGN PATENT DOCUMENTS

| | | | |
|---|---|---|---|
| EP | 2589479 | A2 | 5/2013 |
| EP | 2733412 | A2 | 5/2014 |
| JP | 2008047383 | A | 2/2008 |

* cited by examiner

MOTOR VEHICLE HEADLAMP LIGHTING MODULE WITH MUTUAL POSITIONING OF REFLECTOR AND LENS

CROSS-REFERENCE TO RELATED APPLICATIONS

This application claims priority to the French application 1456227 filed Jun. 30, 2014, which application is incorporated herein by reference and made a part hereof.

BACKGROUND OF THE INVENTION

1. Field of the Invention

The invention relates to the field of lighting, more particularly motor vehicle lighting. The invention relates to a lighting module for a motor vehicle headlamp.

2. Description of the Related Art

Published patent document EP 2 428 725 A2, which is equivalent to U.S. Patent Publication Nos. 2012/0063156 and 2013/0235606 and to U.S. Pat. Nos. 8,534,888 and 9,039,262, discloses a motor vehicle headlamp lighting module. The lighting module in question comprises a light source of the light emitting diode (LED) type mounted on a mounting plate arranged on a radiator heat sink for cooling the diode. The module also comprises a first reflective surface in the form of a half shell able to reflect the rays emitted by the light source toward a second reflective surface, referred to as a reflector, with an edge for cutting off the lighting beam. The lighting module also comprises a lens positioned in front of the second reflective surface. The rays reflected by the first reflective surface and which pass to the front of the cutoff edge of the reflector encounter the lens and are deflected thereby. The rays that encounter the second reflective surface instead of encountering the lens in the lower part thereof with an angle of incidence that is smaller than the preceding rays, are reflected toward the upper part of the lens at essentially the same angle of incidence. These rays are then deflected by the lens toward the bottom of the beam rather than being deflected upward, thus achieving a cutoff typical of a lighting beam of the "dipped" or "low beam" type. In this module, a main component serves to support the lens, the reflective surface in the shape of a half shell, and the reflector. This component is therefore fixed to the radiator. The latter directly supports the mounting plate with the light source. Relative longitudinal positioning of the main component and the radiator is performed by means of eyelets on the main component collaborating through engagement with posts on the radiator. Fixing screws are then screwed into the posts in order to secure the main component to the radiator. The main component comprises stop surfaces collaborating directly with the radiator for the vertical positioning thereof. This teaching is advantageous in that the main component provides accurate relative positioning between the lens, the reflective surface, the reflector and the radiator. Specifically, the lens is fully supported by the main component. In the case of lenses that are bulky and heavy, that may present certain difficulties in terms of the stability of the lens notably when vibrations are present. In addition, the main component is a complicated component which may moreover have certain manufacturing tolerances that potentially detract from the precision of the assembly.

SUMMARY OF THE INVENTION

It is an object of the invention to alleviate at least one of the disadvantages of the prior art, more particularly of the aforementioned prior art. More specifically, it is an objective of the invention to propose a lighting module use of which is simplified while at the same time maintaining a high degree of precision between the lens and the rest of the module, such as notably the reflective surface and the light source or sources.

One subject of the invention is a lighting module, notably a lighting and/or signaling module for a motor vehicle, comprising: at least one light source; a heat sink able to dissipate the heat produced by the light source or sources; a reflective surface able to reflect the rays from the light source or sources; a lens able to deflect the rays from the reflective surface so as to form a beam of light along an optical axis of the module; a support of the lens and of the reflective surface, the support being mounted on the heat sink; notable in that the heat sink and/or the support comprises at least one, and preferably at least two, bosses in contact with the other out of the heat sink and the support so as to maintain a predetermined distance between the heat sink and the support.

According to one advantageous embodiment of the invention, the boss or bosses are directed vertically.

According to one advantageous embodiment of the invention, the boss or bosses are situated, in the direction of the optical axis, between the reflective surface and the lens.

According to one advantageous embodiment of the invention, the lens comprises at least one, preferably at least two, lower fixing lugs extending vertically through the support.

According to one advantageous embodiment of the invention, the support comprises a slot, the lower fixing lug or lugs passing through this slot.

According to one advantageous embodiment of the invention, the or each of the fixing lugs collaborates by engagement with the heat sink, the engagement preferably having a vertical play of less than 0.5 mm, more preferably a vertical play of less than 0.1 mm, and more preferably still, vertical clamping.

According to one advantageous embodiment of the invention, the heat sink comprises a rear portion supporting the light source and a front portion, the boss or bosses being on the front portion.

According to one advantageous embodiment of the invention, the front portion of the heat sink is set at a lower level than the rear portion of the heat sink.

According to one advantageous embodiment of the invention, the heat sink has a staircase profile, the front portion forming a first step of the staircase and the rear portion forming a higher second step of the staircase.

According to one advantageous embodiment of the invention, the support extends along the respective upper surfaces of the front and rear portions of the heat sink, the lens nesting vertically on the support.

According to one advantageous embodiment of the invention, engagement between the lens and the heat sink is on the front portion of the heat sink.

According to one advantageous embodiment of the invention, the front portion of the heat sink comprises at least one, preferably at least two, lugs extending forward and collaborating through engagement with an opening in the fixing lugs of the lens respectively.

According to one advantageous embodiment of the invention, the or each of the lugs of the heat sink forms a stop in the direction of the optical axis for the corresponding fixing lug of the lens.

According to one advantageous embodiment of the invention, the or each of the lugs of the heat sink has a profile, in the direction of the optical axis, that forms a step.

According to one advantageous embodiment of the invention, the or each of the lugs of the heat sink comprises at least one rib extending in the direction of the optical axis so as to engage tightly with the corresponding fixing lug of the lens.

According to one advantageous embodiment of the invention, at least two of the bosses are positioned laterally one on each side of the optical axis of the module.

According to one advantageous embodiment of the invention, the reflective surface and the support are one and the same component. The reflective surface may be formed on a cavity of the support, for example by metalizing this cavity; if appropriate, the reflective surface and the support form one and the same component.

According to one advantageous embodiment of the invention, the support comprises means of positioning with respect to the heat sink and in the direction of the optical axis.

According to one advantageous embodiment of the invention, the positioning means for positioning the support in the direction of the optical axis collaborate with a mounting plate supporting the light source or sources, the mounting plate being positioned on the rear portion of the heat sink.

Advantageously the light source or sources are of the light emitting diode type.

Advantageously, the mounting plate comprises a printed circuit, preferably with a connector, the circuit being connected to the light source or sources in order to power same.

According to one advantageous embodiment of the invention, the positioning means for positioning the support in the direction of the optical axis comprise at least one, preferably at least two, studs, each one of the studs projecting vertically downward into a cavity of the heat sink, the stud or each of the studs collaborating through contact with the edge of an orifice in the mounting plate.

According to one advantageous embodiment of the invention, the heat sink is made of a molded metallic and/or plastic material, the or at least two of the bosses being formed as an integral part of the heat sink and produced at the time of molding of the heat sink.

Another subject of the invention is a lighting device for a motor vehicle, comprising a housing and at least one lighting module, notable in that the module or at least one of the modules is in accordance with the invention.

The measures taken by the invention are advantageous in as much as they make it possible easily and economically to produce a lighting module with precise positioning of the lens with respect to the reflective surface and/or the light source or sources.

These and other objects and advantages of the invention will be apparent from the following description, the accompanying drawings and the appended claims.

BRIEF DESCRIPTION OF THE ACCOMPANYING DRAWINGS

Other features and advantages of the present invention will be better understood from the description and drawings among which:

DETAILED DESCRIPTION OF THE PREFERRED EMBODIMENTS

Figure 1:
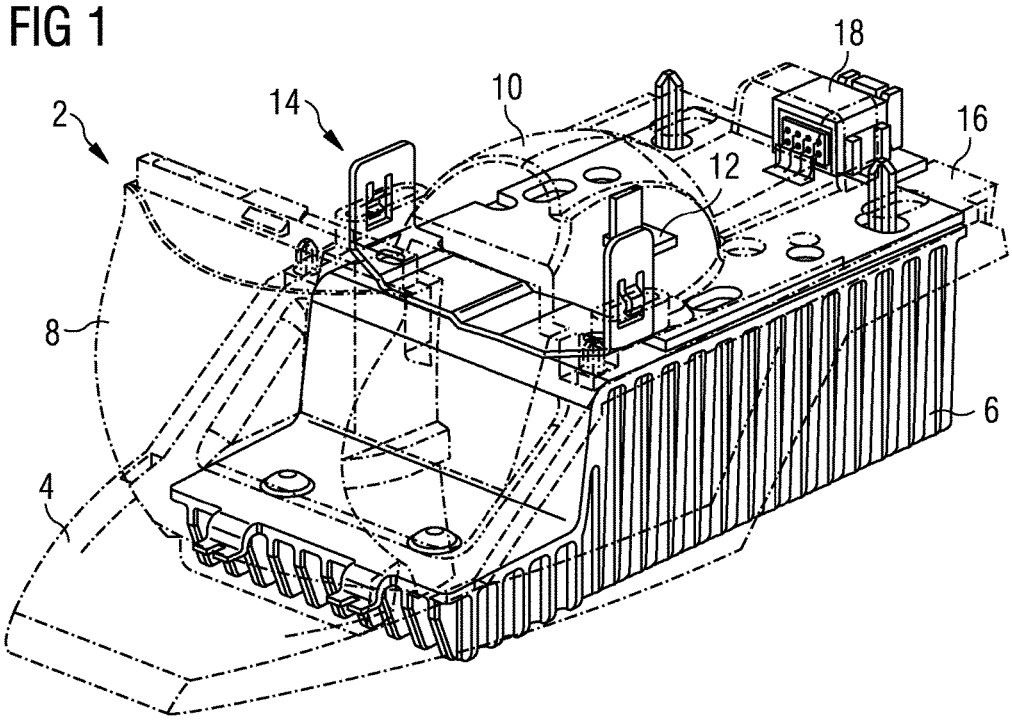
FIG. 1 is a perspective view of a motor vehicle headlamp lighting module according to the invention.

FIG. 1 is a perspective view of a lighting module according to the invention. This lighting module can be mounted in a motor vehicle headlamp. In this particular instance, this module produces a lighting beam with a cutoff such as for a lighting function of the "dipped" or "low beam" type.

The lighting module 2 illustrated in FIG. 1 essentially comprises a radiator, or heat sink 6, on which there is mounted a mounting plate 16 provided with one or more light sources 12, preferably of the light emitting diode type. A support 4 depicted to show hidden detail and extending over the entire length of the lighting module 2 is arranged on the radiator 6. The support is in contact with a lens 8 and comprises a reflective surface 10. The latter takes the overall shape of a half-shell covering the light source 12. The profile of the reflective surface 10 may be generally elliptical with two focal points. The light source 12 is situated at the first focal point and a reflective surface 14 is essentially situated in the plane of the light source 12 and with a front edge situated at the second focal point. The reflective surface 14 is commonly referred to as a "reflector" in so far as it reflects some of the rays from the reflective surface 10 toward an upper part of the lens 8. Indeed, if the reflective surface 14 were absent, the rays passing to the rear of the second focal point would encounter the lens 8 at a low part with a smaller angle of incidence than those passing through the second focal point. These rays would then be deflected by the lens 8 to form the top part of the lighting beam. Reflecting these rays toward a top part of the lens 8 allows this effect to be reversed and the bottom part of the beam to be formed. The front edge of the reflector 14 thus forms a horizontal cutoff of the beam. It may also be noted that the reflective surface of the reflector 14 forms a step in its middle so as to form two different levels of cutoff between the left-hand part and the right-hand part of the lighting beam, in accordance with the vehicle lighting regulations in force in most countries. The use of a reflector to form a lighting beam with a cutoff is well known to those skilled in the art.

The lighting beam is following a main direction commonly referred to as the optical axis of the lighting module 2. This axis also essentially corresponds to the longitudinal axis of the lighting module 2.

It may be seen in FIG. 1 that the mounting plate 16 at its rear part comprises a connector 18 so that it can be connected to the electrical network of the headlamp and of the vehicle.

Figure 2:
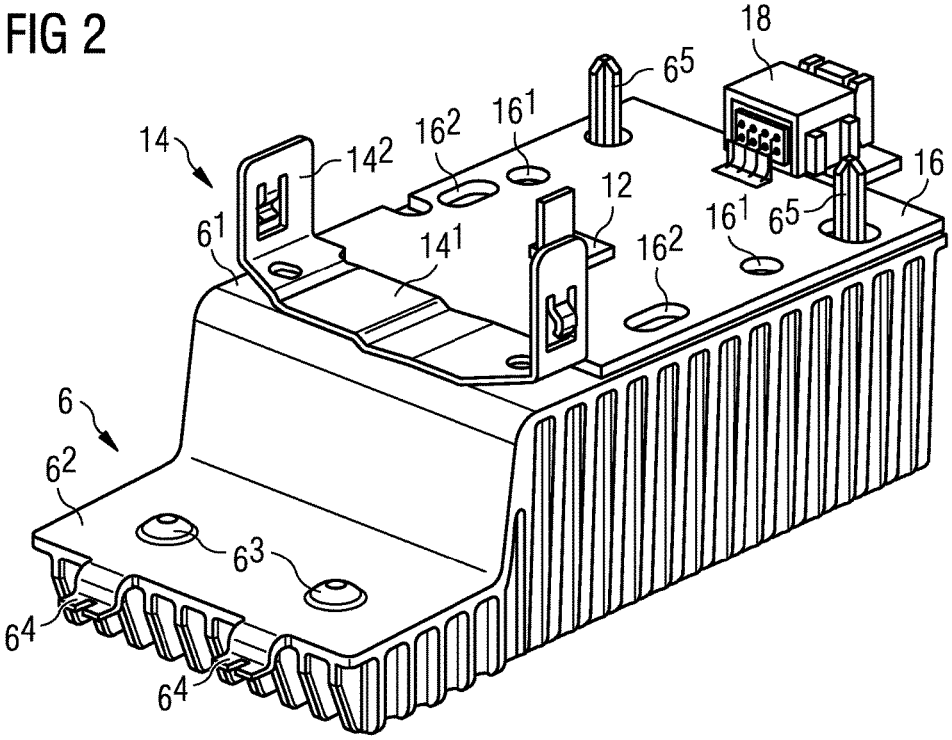
FIG. 2 is a perspective view of the radiator, of the reflector and of the light source of the module of FIG. 1.

FIG. 2 illustrates the radiator 6 of the lighting module 2 of FIG. 1, the radiator 6 being equipped only with the reflector 14 and with the mounting plate 16. It may be seen that the radiator 6 comprises a rear portion $\mathbf{6}^1$ supporting the mounting plate 16 and a front portion $\mathbf{6}^2$. The front portion $6^2$ is at a lower level than the rear portion $6^1$. The profile of the radiator 6 is similar to that of a staircase, the front portion $6^2$ corresponding to a first step and the rear portion $6^1$ forming a second step higher than the first.

The reflector 14 is essentially situated level with the front edge of the rear portion $6^1$. More specifically, the reflector 14 comprises a reflective central portion $14^1$ and two lateral portions $14^2$ in the form of connecting arms for fixing to the support 4 (FIG. 1). This fixing will be detailed further in relation to FIG. 6. The reflector 14 thus has a U-shaped cross transverse profile in which only the central portion $14^1$ is optically active. The reflector 14 may be made from a portion of sheet metal, by forming, bending and cutting.

The front portion $6^2$ on its upper surface comprises two bosses $6^3$. These bosses $6^3$ are intended to ensure exact positioning of the support 4 in the vertical direction, as will be detailed in conjunction with FIGS. 3 and 4. These bosses $6^3$ may be more numerous. There may equally be one or several bosses $6^3$ extending transversely, in the manner of a rib.

Figure 3:
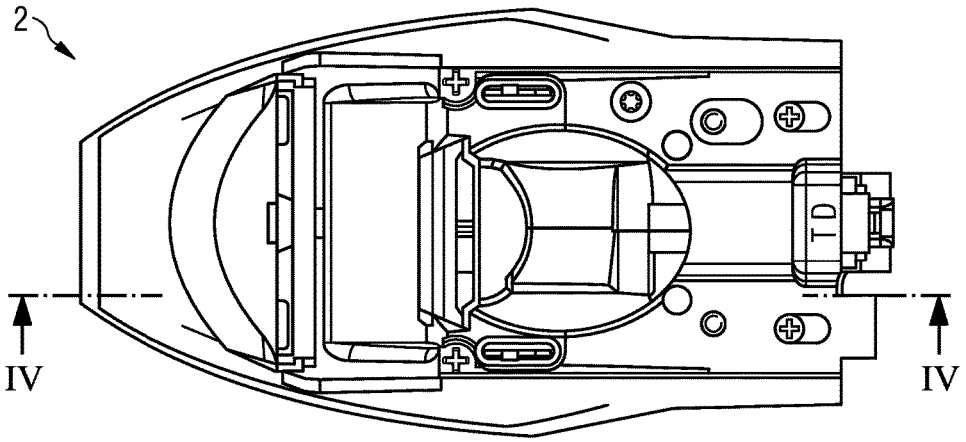
FIG. 3 is an elevation of the module of FIG. 1, showing a line of section IV-IV.
Figure 4:
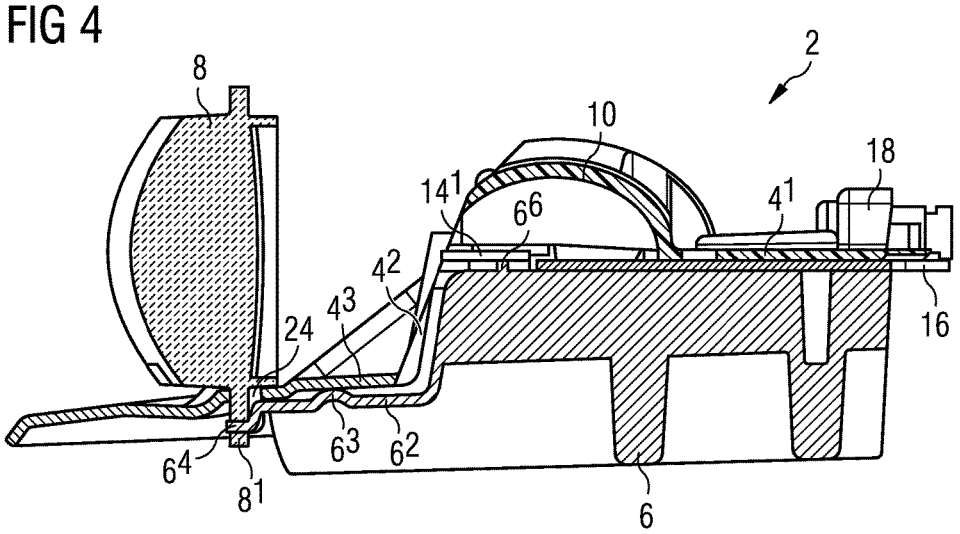
FIG. 4 is a view in section on IV-IV of the module of FIG. 3.

The front portion $6^2$ also comprises, at its front edge, two lugs $6^4$ for attaching the lens 8 (FIG. 1), as will be detailed in conjunction with FIGS. 3 and 4. As visible in FIG. 2, the rear portion $6^1$ may comprise one or more pins, in this instance two pins $6^5$ which are intended to pass through corresponding orifices in the mounting plate 16. These pins $6^5$ may be generally conical. The mounting plate 16 also has orifices $16^1$ intended to accommodate fixing screws and oblong holes $16^2$ intended to allow longitudinal positioning, which means to say positioning in the direction of the optical axis, of the support 4 with respect to the mounting plate 16.

FIG. 3 is a view in elevation of the module of FIG. 1. FIG. 4 is a depiction in section on the line IV-IV of FIG. 3. It may be seen that the support 4 comprises several portions, in this instance a rear portion $4^1$ in contact with the mounting plate 16 on the rear portion $6^1$ of the radiator 6, an intermediate portion $4^2$ and a front portion $4^3$ which is arranged above the front portion $6^2$ of the radiator 6 and on its bosses $6^3$.

It may be seen in FIG. 4 that the lens 8 comprises two fixing lugs $8^1$ extending from a lower edge towards the lugs $6^4$ of the radiator 6. More specifically, these lugs $8^1$ pass through openings 24 in the front portion $4^3$ of the support 4. These lugs $8^1$ may have cavities, or through-passages, fitting over the ends of the lugs $6^4$. As may be seen in FIG. 4, the front portion $4^3$ of the support 4 rests, via its lower face, on the bosses $6^3$ and, via its upper face, on the lens 8. The front portion $4^3$ is thus exactly vertically positioned with respect to the radiator 6 and with respect to the lens 8.

The fit between the lugs $6^4$ of the radiator 6 and the orifices or cavities of the fixing lugs $8^1$ of the lens 8 is practically free of play, more particularly a tight clamping fit. With reference to FIG. 2, it may be seen that the lugs $6^4$ of the radiator 6 may at their ends have longitudinal ribs intended to clamp slightly against the fixing lugs $8^1$ of the lens. As the material of the lens 8 is preferably a translucent or transparent plastics material, such as polycarbonate for example, the fixing lugs $8^1$ may deform a little as they are fitted onto the lugs $6^4$, in order to prevent any mechanical clearance and uncertainty as to the vertical positioning of the lens 8.

As far as the longitudinal positioning of the lens 8 is concerned it may be seen from FIG. 4 and from FIG. 2 that the lugs $6^4$ form an S-shaped profile, namely a profile with a step, this step forming a stop surface in the longitudinal direction of the lighting module 2. Longitudinal positioning of the fixing lugs $8^1$ of the lens 8 is thus also afforded.

Figure 5:
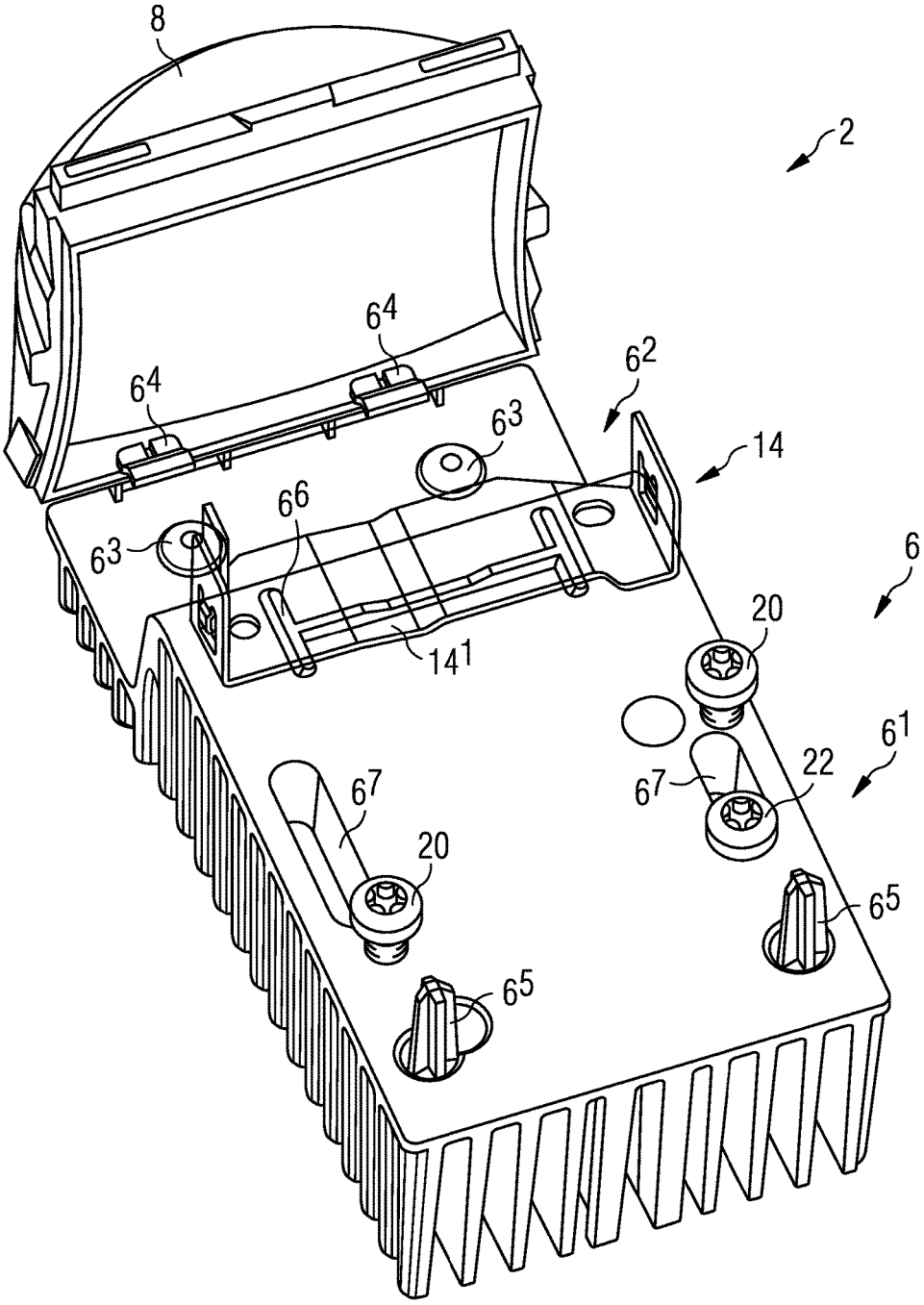
FIG. 5 is a perspective view of the radiator provided with the reflector in which this reflector is drawn to show the hidden detail of the ribs used to position the reflector on the radiator.
Figure 6:
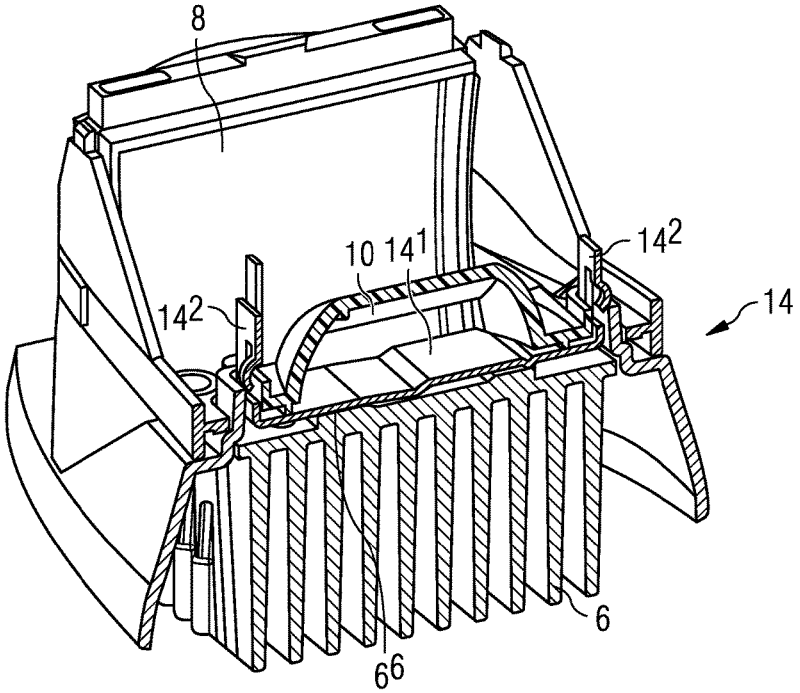
FIG. 6 is a view in cross section of the module of FIG. 1 in the region of the reflector.

Still in FIG. 4, it may be seen that the reflector 14, more specifically the central and optically active portion $14^1$ thereof, rests against a rib $6^6$ of the radiator 6, which rib $6^6$ will be detailed further in relation to FIGS. 5 and 6.

FIG. 5 illustrates the radiator 6 of the lighting module 2 of FIG. 1, equipped only with the lens 8 and with the reflector 14, the latter being depicted to show hidden detail. It may be seen that the radiator 6 comprises H-shaped ribs $6^6$ in the longitudinal direction of the lighting module 2. These ribs $6^6$ act as bearing surfaces for the reflector 14 because it is important for the reflector 14 and, more particularly, the reflective central portion $14^1$ thereof to be parallel to the upper surface of the rear portion $6^1$ of the radiator 6. This is because any misalignment of the reflecting surface of the reflector 14 is liable to alter appreciably the photometry of the light beam of the module. It is therefore important to be able to position the reflector 14 very precisely not only translationally in the longitudinal direction but also vertically and in terms of rotation about a transverse axis. The ribs $6^6$ provide vertical positioning and positioning for rotation about a transverse axis of the reflector 14. They also make it possible to avoid any light leaking out between the lower face of the central portion $14^1$ and the upper face of the rear portion $6^1$ of the radiator 6.

Figure 8:
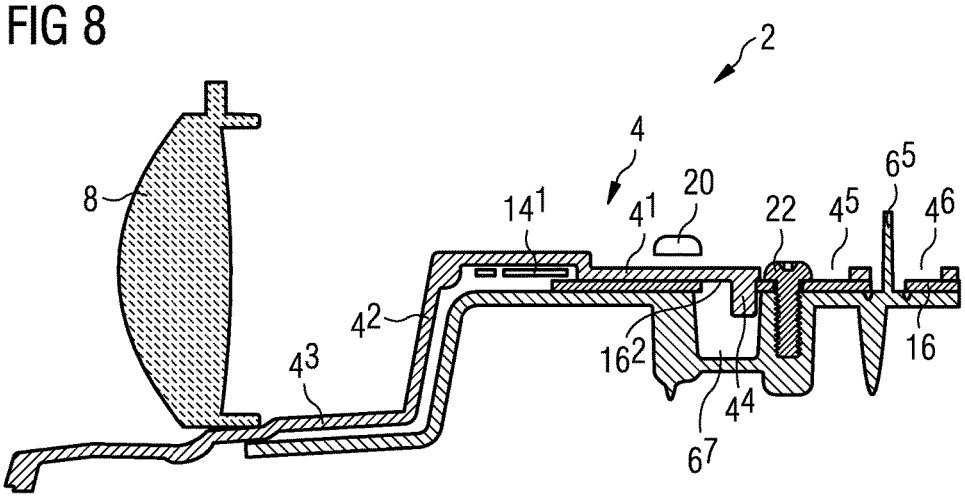
FIG. 8 is a view in section on VIII-VIII of the module of FIG. 7.
Figure 9:
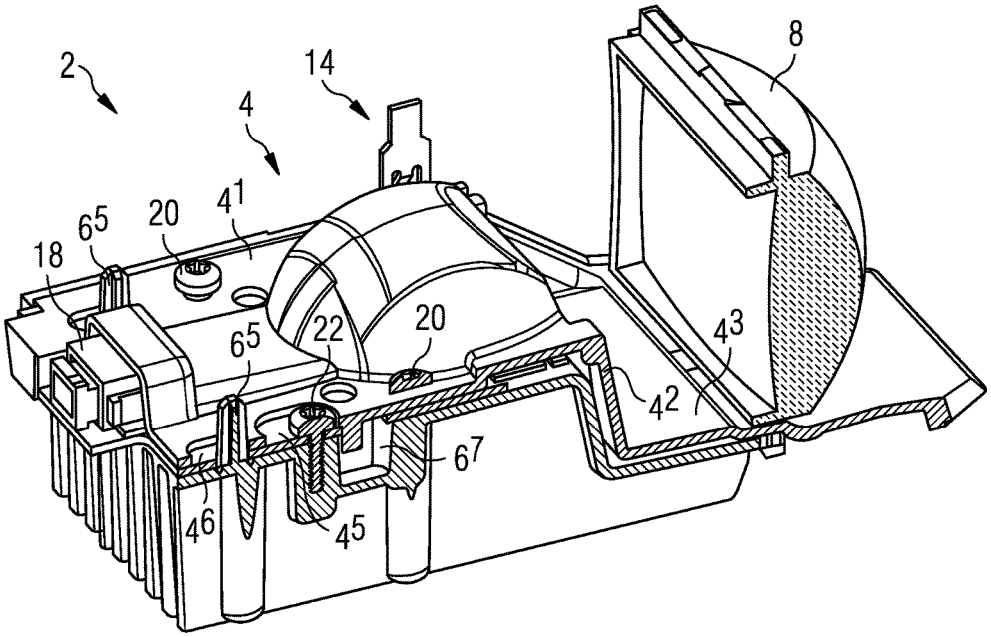
FIG. 9 is a view in section on VIII-VIII of the module of FIG. 7, although the view is given in perspective and the section is the opposite to that of FIG. 8.

It may also be seen from FIG. 5 that the rear portion $6^1$ of the radiator 6 comprises two cavities $6^7$ the function of which will be detailed in relation to FIGS. 8 and 9.

Fixing screws 20 and 22 of the mounting plate supporting the light source and of the support are visible in FIG. 5.

FIG. 6 is a view in cross section of the module of FIG. 1, the section being taken in the region of the reflector 14. This view illustrates how the reflector 14 is fixed and positioned. It may be seen that the central portion $14^1$ of the reflector does indeed rest against the transverse ribs $6^6$ of the radiator 6. It may also be seen that the fixing arms $14^2$ of the reflector collaborate through engagement with orifices in the support 4. These arms $14^2$ may for this purpose comprise retaining tabs intended to allow the arms $14^2$ to be inserted into the orifices and to prevent them from leaving these orifices. Other fixing and/or retaining means may be contemplated.

The ribs $6^6$ illustrated in FIGS. 5 and 6 are preferably formed as integral parts of the radiator 6. The latter is preferably made of a metallic or plastics material that can be molded, such as, for example, aluminum or thermoplastics that have heat conduction properties. It is therefore advantageous for these ribs to be produced directly at the time of producing the radiator.

It should be noted that the shape of these ribs may deviate from that illustrated in FIGS. 5 and 6. Specifically, they could for example comprise two transverse ribs parallel to and distant from one another. They could also have a U-shaped or even rectangular profile. They could equally take the form of a number of isolated bosses.

Figure 7:
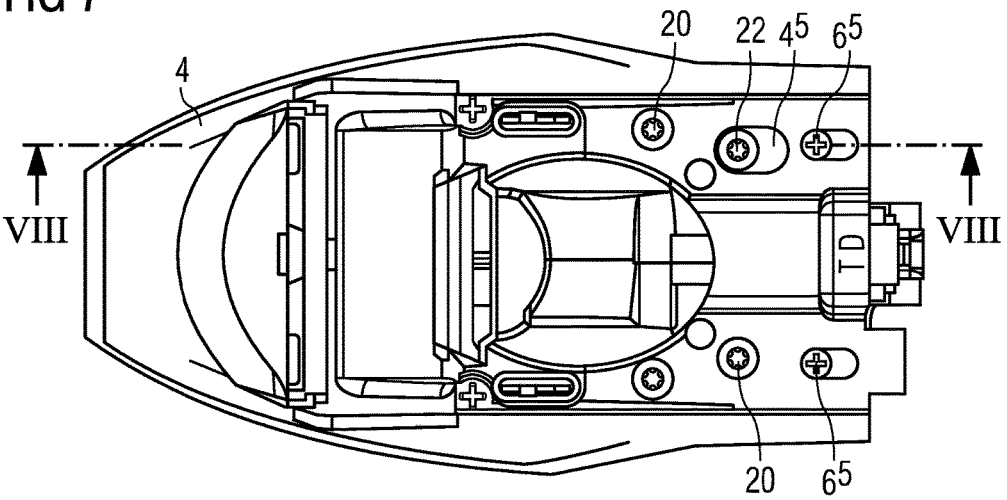
FIG. 7 is an elevation of the module of FIG. 1, showing a line of section VIII-VIII.

FIG. 7 is an elevation of the module of FIG. 1. Unlike FIG. 3, FIG. 7 illustrates the module provided with the fixing screws 20 and 22 which are visible notably in FIG. 5. As can be seen in FIG. 7, the line of section VIII-VIII passes through an oblong hole $4^5$ of the support 4 and through one of the pins $6^5$ of the radiator 6. The head of the fixing screw 22 passing through this oblong hole is fully housed by the hole, meaning that this screw does not press against the support 4 but does indeed press only on the mounting plate 16.

FIG. 8 is a section on VIII-VIII of FIG. 7. FIG. 9 is a view in section on VIII-VIII of the lighting module 2 of FIG. 7 although the view is in perspective and the view point for the section is the opposite of that of FIG. 8.

There it may be seen that the support 4 comprises two studs $4^4$, one on each side of the longitudinal or optical axis of the lighting module 2. Each of these studs $4^4$ extends from the rear portion $4^1$ of the support toward a cavity $6^7$, namely essentially vertically downward. Each of the studs $4^4$ also passes through an oblong hole $16^2$ made in the mounting plate 16 and rests in the longitudinal direction against the edge of the hole $16^2$. In this particular instance, the bearing force is directed rearward, namely that it is the rear portion of the edge of the oblong hole $16^2$ that is in contact with the stud $4^4$. However, it must be understood that this bearing force could be directed forward in an alternative.

The cavities $6^7$ may be dimensioned to allow the studs $4^4$ to move freely therein as the support 4 is being positioned. For that purpose the cavity may extend beyond the edge of the oblong hole $16^2$ against which the stud $4^4$ abuts.

The mounting plate 16 is fixed by the screw 22 passing through the oblong hole $4^5$ in the support 4. The mounting plate 16 may be positioned on the radiator 6 by two pins $6^5$ of the radiator 6 which collaborate with corresponding orifices of the mounting plate 16. As the support 4 is being fitted, after having positioned and possibly fixed the mounting plate 16, the rear portion $4^1$ of the support 4 is placed against the mounting plate 16 taking care to ensure that the studs $4^4$ enter the oblong holes $16^2$ of the mounting plates 16 and the corresponding cavities $6^7$ of the radiator 6. Oblong holes $4^6$ may be provided for collaborating with the pins $6^5$ while at the same time allowing the support 4 some movement. When the rear portion $4^1$ of the support 4 is in contact with the mounting plate 16, the support 4 can then be moved essentially in the longitudinal direction so as to bring each of the studs $4^4$ into contact with the corresponding edge of the oblong holes $16^2$ of the mounting plate 16. The fixing screws 20 pressing against the support 4 may then be fitted and tightened in order to fix the support 4 and the mounting plate 16 to the radiator 6.

The use of the studs $4^4$ as stop means in the longitudinal direction acting between the support 4 and the mounting plate 16 means that the relative positioning of the reflective surface 10, supported by the support 4, and of the light source 12 can be ensured.

It should be noted that the studs $16^2$ and the oblong holes $16^2$ of the mounting plate 16 with which they collaborate may be designed to provide positioning not only in the longitudinal direction but also in the transverse direction, namely positioning in the plane of sliding between the mounting plate 16 and the rear portion of the support 4. To do that, the edges of the oblong holes $16^2$ and/or the corresponding stud $4^4$ may be profiled in such a way as to center the corresponding stud $4^4$.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lighting module, notably a lighting and/or signaling module for a motor vehicle, comprising:

at least one light source;

a heat sink able to dissipate the heat produced by said at least one light source;

a reflector having a reflective surface able to reflect the rays from said at least one light source;

a lens able to deflect the rays from said reflective surface so as to form a beam of light along an optical axis of said lighting module;

a support of said lens and of said reflective surface, said support being mounted directly above said heat sink in a direction perpendicular to the optical axis of the lighting module;

wherein at least one of said heat sink and said support comprises at least one boss in contact with the other of said support and said heat sink, respectively, so as to maintain a predetermined distance between said heat sink and said support;

wherein said at least one boss is configured to cause a first portion of said support to be positioned directly above said heat sink in the direction perpendicular to the optical axis of the lighting module, said support comprising a second portion that engages said lens;

wherein said lens comprises at least one lower fixing lug extending vertically through said support;

wherein a front portion of said heat sink comprises at least one lug extending forward and collaborating through engagement with an opening in said at least one lower fixing lug of said lens respectively.

2. The lighting module according to claim 1, wherein said at least one boss is situated, in the direction of said optical axis, between said reflective surface and said lens.

3. The lighting module according to claim 2, wherein said lens comprises at least one lower fixing lug extending vertically through said support.

4. The lighting module according to claim 2, wherein said heat sink comprises a rear portion supporting said light source and a front portion, said at least one boss being on said front portion.

5. The lighting module according to claim 1, wherein said at least one lower fixing lug collaborates by engagement with said heat sink, said engagement having a vertical play of less than 0.5 mm.

6. The lighting module according to claim 5, wherein said heat sink comprises a rear portion supporting said light source and a front portion, said at least one boss being on said front portion.

7. The lighting module according to claim 6, wherein said at least one lug of said heat sink forms a stop in the direction of said optical axis for the corresponding at least one lower fixing lug of said lens.

8. The lighting module according to claim 6, wherein said at least one lug of said heat sink has a profile, in the direction of said optical axis, that forms a step.

9. The lighting module according to claim 6, wherein said at least one lug of said heat sink comprises at least one rib extending in the direction of said optical axis so as to engage tightly with the corresponding one of said at least one lower fixing lug of said lens.

10. The lighting module according to claim 6, wherein said support comprises means for positioning the support with respect to said heat sink and in the direction of said optical axis.

11. The lighting module according to claim 10, wherein said means for positioning said support in the direction of said optical axis collaborate with a mounting plate supporting said at least one light source, said mounting plate being positioned on said rear portion of said heat sink.

12. The lighting module according to claim 11, wherein said means for positioning said support in the direction of said optical axis comprise at least one stud, each stud projecting vertically downward into a cavity of said heat sink, said stud collaborating through contact with an edge of an orifice in said mounting plate.

13. The lighting module according to claim 1, wherein said support comprises a slot, said at least one lower fixing lug or lugs passing through said slot.

14. The lighting module according to claim 13, wherein said at least one lower fixing lug collaborates by engagement with said heat sink, said engagement having a vertical play of less than 0.5 mm.

15. The lighting module according to claim 1, wherein said reflective surface and said support are one and the same component.

16. A lighting device for a motor vehicle, comprising a housing and at least one lighting module according to claim 1.

* * * * *